US007284304B2

(12) United States Patent
Fenton et al.

(10) Patent No.: US 7,284,304 B2
(45) **Date of Patent: *Oct. 23, 2007**

(54) RETAINING ASSEMBLY

(75) Inventors: Timm John Fenton, Califon, NJ (US); Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 71 days.

This patent is subject to a terminal disclaimer.

(21) Appl. No.: 11/238,735

(22) Filed: Sep. 29, 2005

(65) Prior Publication Data

US 2006/0143880 A1 Jul. 6, 2006

Related U.S. Application Data

(63) Continuation-in-part of application No. 11/026,440, filed on Dec. 30, 2004.

(51) Int. Cl.
*A44B 11/25* (2006.01)

(52) U.S. Cl. ..... 24/654

(58) Field of Classification Search ..... 24/652–656, 24/601.6, 669, 702, 600.4, 600.5, 600.7, 24/600.8
See application file for complete search history.

(56) References Cited

U.S. PATENT DOCUMENTS

| | | | | |
|---|---|---|---|---|
| 1,062,653 | A * | 5/1913 | Koons | 24/600.8 |
| 6,408,493 | B1 * | 6/2002 | Yurman et al. | 24/600.4 |
| 2005/0204457 | A1 * | 9/2005 | Stiles et al. | 2/425 |
| 2006/0143879 | A1 * | 7/2006 | Fenton et al. | 24/640 |

* cited by examiner

*Primary Examiner*—James R Brittain
(74) *Attorney, Agent, or Firm*—Baker Botts L.L.P.

(57) ABSTRACT

A retaining assembly includes a first portion capable of being attached a strap, a second portion capable of being secured to the first portion, the second portion including a retaining portion capable of cooperating with a harnessing member; and a member capable of sliding over the retaining portion and cooperating with the second portion in a plurality of positions. When the member is in a first position, the combination of the retaining portion and the member is capable of retaining the harnessing member, and the retaining assembly is prevented from pivoting around the harnessing member.

9 Claims, 4 Drawing Sheets

RETAINING ASSEMBLY

PRIORITY AND RELATED APPLICATION

This application is a continuation-in-part of U.S. patent application Ser. No. 11/026,440 filed Dec. 30, 2004 for "Retaining Assembly," the disclosure of which is hereby incorporated by reference in its entirety.

FIELD

This application relates generally to retaining assemblies and particularly to retaining assemblies for attaching a strap to an item of luggage.

BACKGROUND INFORMATION

Retaining assemblies serve a variety of functions. They can be used for attaching a set of keys to a belt buckle, for example, or may be used to hold a device such as a whistle, or may be used to attach a strap to an item of luggage. Many retaining assemblies include a generally J-shaped portion, and an additional portion to complete the "circle." The additional portion typically communicates with a spring that keeps the additional portion pressed against the end of the J-shaped portion, unless a force is applied on a protrusion attached to the additional portion to overcome the spring force. In order to keep the additional portion in contact with the end of the J-shaped portion, a relatively stiff spring is chosen. Thus, depending on the application, the amount of force to be applied to the protrusion necessary to overcome the spring is high.

In some other arrangements, the entire J-shaped portion slides linearly in order to engage and disengage. In this manner, an item can be placed on the retaining assembly when the J-shaped portion is in an open position. When the user presses on the J-shaped portion, the user slides it manually into a closed position, retaining whatever item has been placed on the retaining assembly. A user typically presses a release button, and the J-shaped portion is released by a mechanism that includes a spring pushing it linearly outward. Such devices are typically fabricated from plastic, and thus are susceptible to fracture under heavy loading. In addition, since the J-shaped member is the harnessing feature as well as the sliding feature, under loading, the J-shaped member tends to separate from the rest of the assembly and the retaining assembly may disengage from whatever item it was attached to.

SUMMARY OF THE PRESENT INVENTION

One of the objects of the present invention is to overcome the aforementioned problems and deficiencies.

For example, in one exemplary embodiment of the present invention, a retaining assembly includes a first portion adapted to be attached to a strap; a second portion capable of being secured to the first portion, the second portion including a retaining portion capable of cooperating with a harnessing member; and a member capable of sliding over the retaining portion and cooperating with the second portion in a plurality of positions; wherein, when the member is in a first position, the combination of the retaining portion and the member is capable of retaining the harnessing member, and when the member is in the first position, the retaining assembly is prevented from pivoting around the harnessing member.

In this embodiment, the load is predominately carried by the retaining portion of the second portion, which may be fabricated from a stronger material than the member. In a preferred arrangement, the second portion is fabricated from a metallic material and the member is fabricated from a thermoplastic material. The load being carried primarily by the retaining portion helps prevent accidental disengagement of the member merely by the presence of the load. This allows the member to be fabricated from plastic saving cost and weight. Thus, the present invention may achieve the proper balance between strength, cost, appearance, and durability.

DRAWINGS

Figure 1:
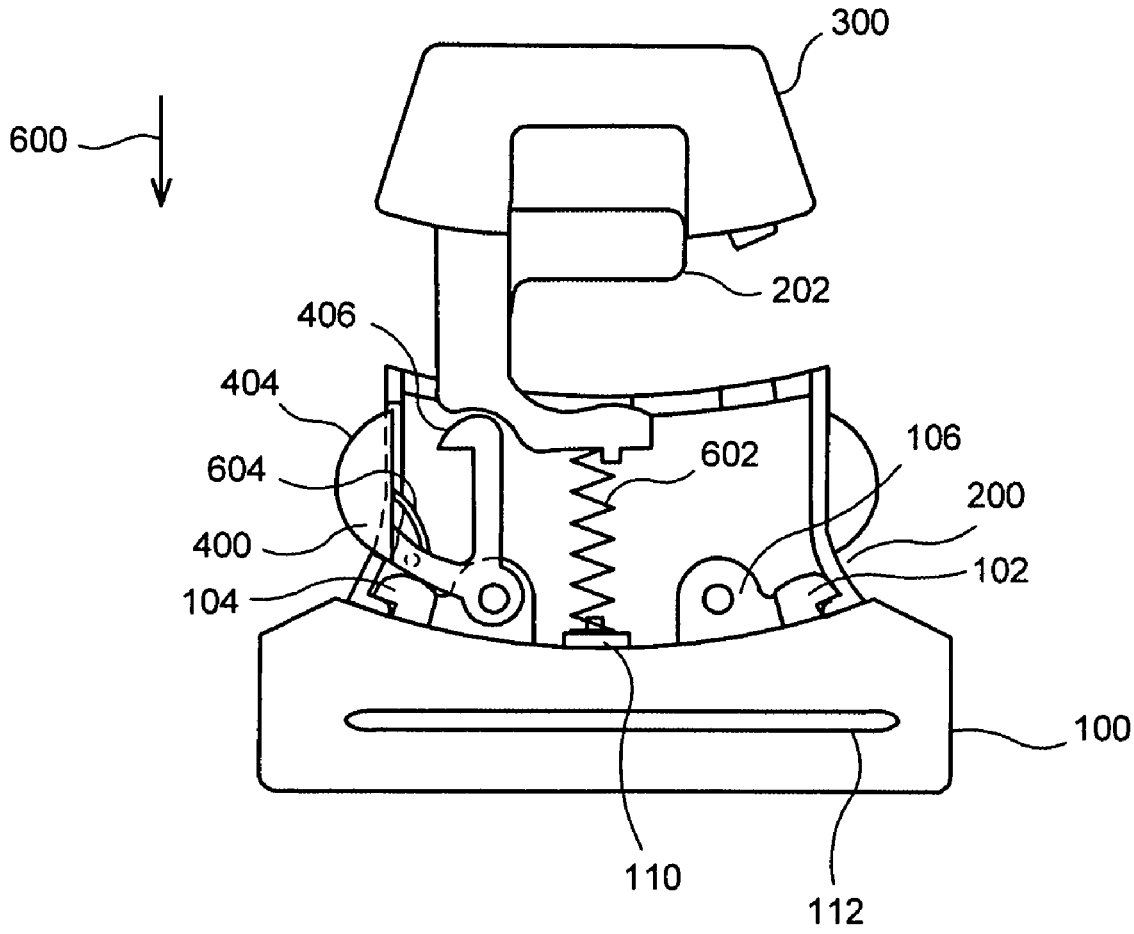
FIG. 1 shows a front view of a first exemplary embodiment of a retaining assembly according to the present invention.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION

FIG. 1 depicts a first exemplary embodiment according to the present invention. The retaining assembly includes a first portion 100 and a second portion 200. The retaining assembly further includes a latching member 300. FIG. 1 depicts the latching member in an "open" position.

Figure 2:
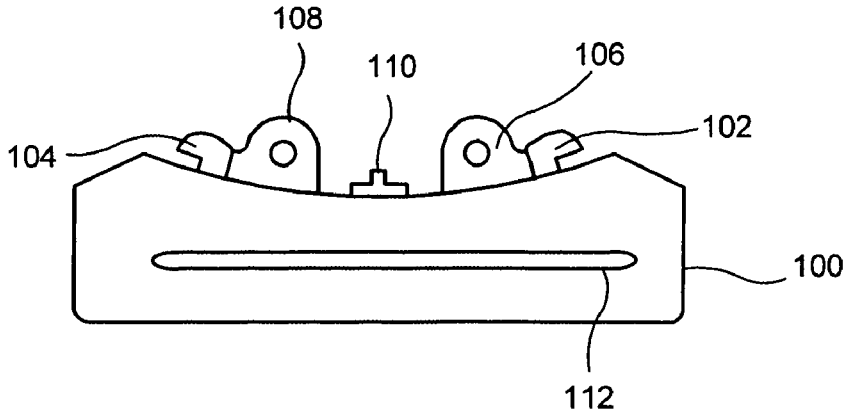
FIG. 2 is a front view of a first component of the first exemplary embodiment.

FIG. 2 depicts an isolated view of the first portion 100. The first portion 100 may be fabricated from a thermoplastic material or from a metal such as aluminum. The first portion 100 may include engaging features 102, 104. The first portion 100 may include boss retainers 106, 108. The first portion 100 may include a spring locator 110, for positioning a spring to cooperate with the latching member 300. The first portion 100 may also include a retaining slot 112 for attachment to a strap.

Figure 3:
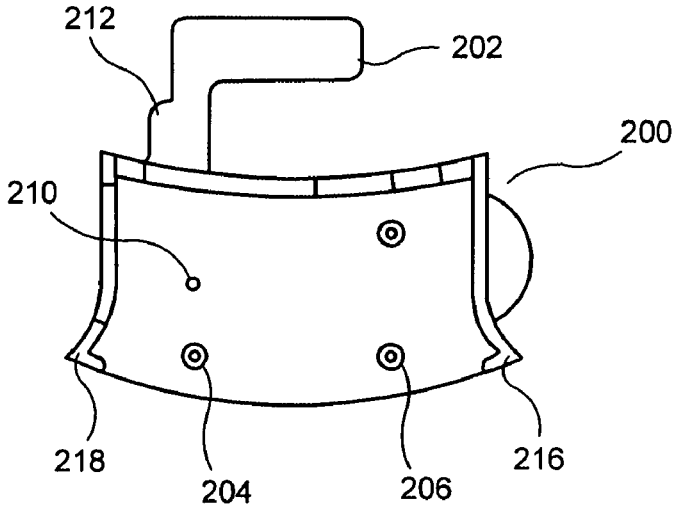
FIG. 3 is a front view of a second component of the first exemplary embodiment.

FIG. 3 depicts a front view of the second portion 200. The second portion 200 may be fabricated from a metal such as aluminum. The second portion 200 includes a retaining portion 202. The retaining portion may be generally C-shaped. The second portion 200 may include bosses 204, 206 to fit into the boss retainers 106, 108 of the first portion 100. The bosses 204, 206 may also serve to retain screws (not shown) to retain a covering member 500 (see FIG. 10) to the second portion 200. The second portion 200 may also include a torsion spring locator 210, for interacting with a torsion spring. The second portion 200 may also include engaging features 216, 218 to cooperate with the engaging features 102, 104 of the first portion 100. Thus, the first portion 100 and the second portion 200 may be held together via a press fit of these engaging features.

Figure 4:
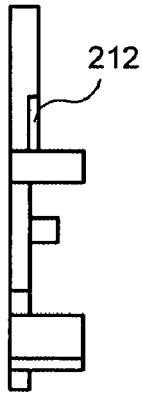
FIG. 4 is a side view of the second component of the first exemplary embodiment.

FIG. 4 depicts a side view of the second portion 200, and shows a protrusion 212, which may cooperate with a groove in the latching member 300, and may assist in resisting any torsional load placed on the latching member while in the "closed position" on the second portion 200. The presence of the protrusion also aids a user when placing the latching member 300 in the closed position.

Figure 5:
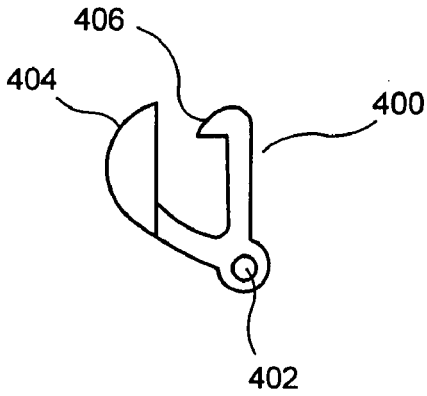
FIG. 5 is a front view of a third component of the first exemplary embodiment.

FIG. 5 depicts a front view of a release lever 400. The release lever may include a locating hole 402 for placement on the boss 204 of the second portion 200. When a user presses on a side extension 404 of the release lever 400 when the latching member 300 is in the closed position, a retaining latch 406 may disengage the latching member 300 and may allow the latching member 300 to move vertically upward.

Figure 6:
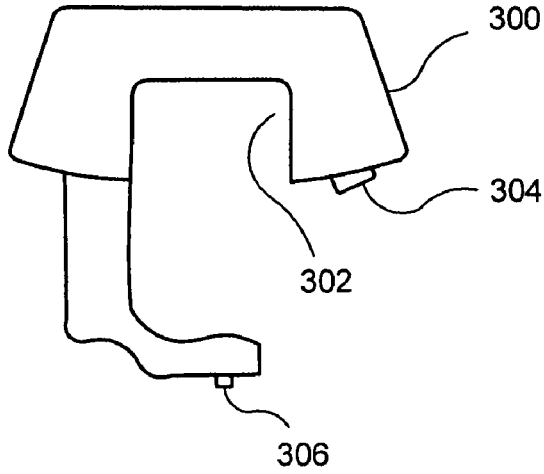
FIG. 6 is a front view of a fourth component of the first exemplary embodiment.

FIG. 6 depicts a front view of the latching member 300. The latching member 300 may be generally J-shaped. The latching member may be fabricated from an inexpensive material, such as a thermoplastic. When the latching member is in the closed position, the retaining area 302 may completely close the "C" shaped area created by the retaining portion 202 of the second portion 200. The latching member 300 may include a protrusion 304 to assist in locating and retaining the latching member 300 from the second portion 200 when the latching member 300 is in the closed position. The latching member 300 may include a spring locator 306, for positioning a spring to cooperate with the first portion 100.

Figure 7:
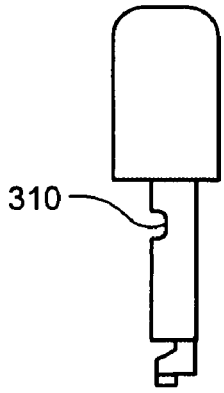
FIG. 7 is a side view of the fourth component of the first exemplary embodiment.

FIG. 7 depicts a side view of the latching member 300. The latching member 300 may include a retaining section 310 for engaging the retaining latch 406 of the release lever 400 when the latching member 300 is in the closed position.

Figure 8:
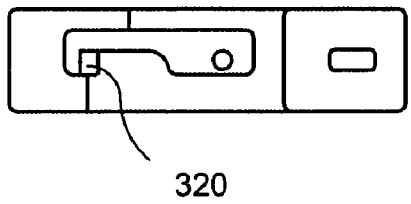
FIG. 8 is a bottom view of the fourth component of the first exemplary embodiment.

FIG. 8 depicts a bottom view of the latching member 300. The latching member 300 may include a groove 320 which may cooperate with the protrusion 212 of the second portion 200.

Figure 9:
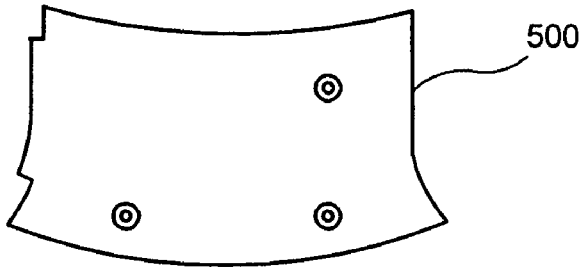
FIG. 9 is a front view of a fifth component of the first exemplary embodiment.

FIG. 9 depicts a front view of the covering member 500. The covering member may be fabricated from a material such as a thermoplastic. The covering member 500 may be assembled to the second portion 200 and may be fastened together by the use of screws (not shown).

With reference again to FIG. 1, the individual components of the retaining assembly 100 are shown (but the covering member 500 is not shown). A user may slide the retaining assembly 100 over a harnessing member 700 while the latching member 300 is in the open position as shown. The user may then press on the latching member 300 in the direction of the arrow 600. The latching member will act against the locating spring 602 and should be pressed down until the retaining section 310 engages the retaining latch 406 of the release lever 400. The retaining assembly 100 may include a torsion spring 604 to keep the retaining latch 406 positioned such that it will engage the retaining section 310.

Figure 10:
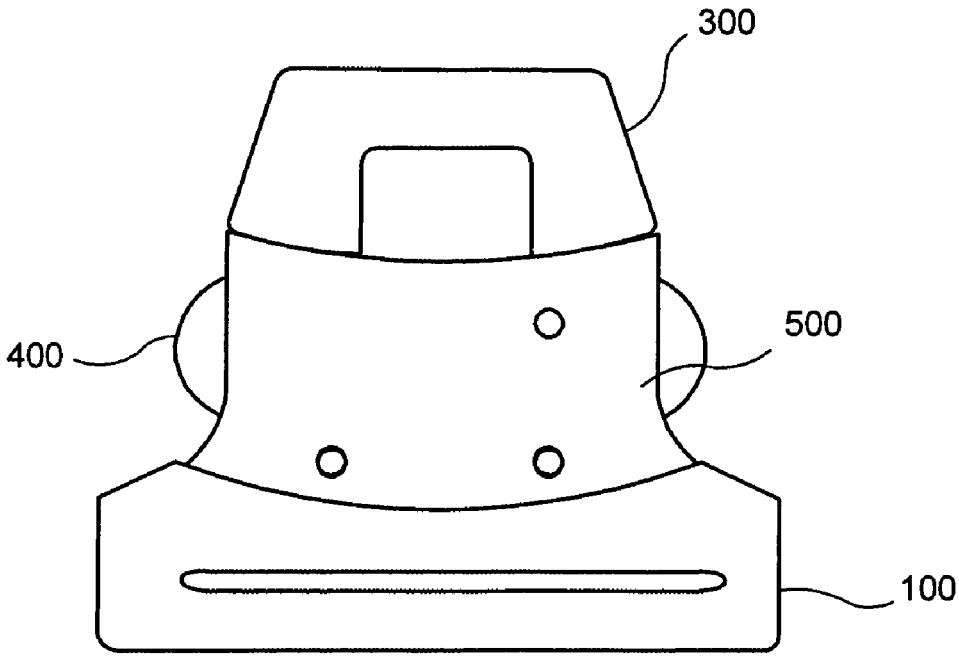
FIG. 10 shows a front view of the first exemplary embodiment of a retaining assembly according to the present invention in a secured position.

FIG. 10 depicts the retaining assembly in the closed position (the covering member 500 is shown in this view).

Figure 11:
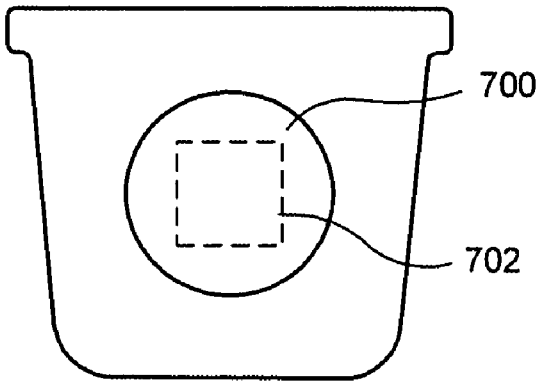
FIG. 11 shows a harnessing member suitable for use with the retaining assembly of FIG. 1.

FIG. 11 depicts a harnessing member 700 suitable for use with the retaining assembly of FIG. 1.

Figure 12:
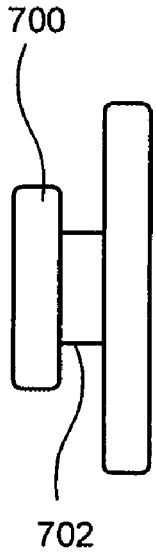
FIG. 12 depicts a side view of the harnessing member of FIG. 11.

FIG. 12 depicts a side view of the harnessing member of FIG. 11.

When the retaining assembly is in the closed position and assembled to the harnessing member 700, the retaining assembly may be prevented from pivoting about the harnessing member 700. This may be due to the shape of each. The harnessing member 700 may be rectangular in cross-section in a region 702 that secures the retaining member. The retaining portion 202 may be semi-rectangular and configured to cooperate with the harnessing member region 702 in order to prevent rotation. Attachment of the retaining assembly to the harnessing member 700 (and thus to the item of luggage itself) with a non-pivotal connection may be more user-friendly than attachment via a harnessing post interacting with a semi-circular retaining portion. When rotation is prevented, it may be easier for the user to carry the item of luggage with the strap on his or her shoulder.

The foregoing merely illustrates the principles of the invention. Various modifications and alterations to the described embodiments will be apparent to those skilled in the art in view of the teachings herein. It will thus be appreciated that those skilled in the art will be able to devise numerous systems and methods which, although not explicitly shown or described herein, embody the principles of the invention and are thus within the spirit and scope of the invention.

What is claimed is:

1. A retaining assembly comprising:

a first portion capable of being attached to a strap;

a second portion capable of being secured to the first portion, the second portion including a retaining portion capable of cooperating with a harnessing member; and a latching member capable of sliding over the retaining portion and cooperating with the second portion in a plurality of positions;

wherein, when the latching member is in a first position, the combination of the retaining portion and the latching member is capable of retaining the harnessing member, and the retaining assembly is prevented from pivoting around the harnessing member.

2. The retaining assembly of claim 1, wherein the retaining portion is approximately C-shaped.

3. The retaining assembly of claim 1, further comprising a spring capable of positioning the latching member in a second position to allow the retaining assembly to be assembled to the harnessing member.

4. The retaining assembly of claim 1, wherein at least a section of the latching member is approximately J-shaped.

5. The retaining assembly of claim 1, wherein the second portion comprises a metal.

6. The retaining assembly of claim 5, wherein the metal comprises aluminum.

7. The retaining assembly of claim 1, wherein the latching member comprises a thermoplastic.

8. The retaining assembly of claim 1, wherein the harnessing member is rectangular in at least a part of its cross-section.

9. The retaining assembly of claim 1, wherein the retaining portion comprises a semi-rectangular shape.

* * * * *